US008342317B2

(12) United States Patent
Möckli

(10) Patent No.: US 8,342,317 B2
(45) Date of Patent: Jan. 1, 2013

(54) PROCESSING ON A TRANSPORTER

(75) Inventor: Heinz Möckli, Grüt (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 13/243,115

(22) Filed: Sep. 23, 2011

(65) Prior Publication Data

US 2012/0007303 A1 Jan. 12, 2012

Related U.S. Application Data

(63) Continuation of application No. 12/043,618, filed on Mar. 6, 2008, now abandoned, which is a continuation of application No. 11/111,948, filed on Apr. 22, 2005, now Pat. No. 7,591,223.

(30) Foreign Application Priority Data

Apr. 22, 2004 (CH) ..... 70704

(51) Int. Cl.
*B65G 47/00* (2006.01)

(52) U.S. Cl. ..... 198/617; 198/470.1; 198/681; 271/204

(58) Field of Classification Search ..... 198/617, 198/470.1, 681, 803.3; 271/204
See application file for complete search history.

(56) References Cited

U.S. PATENT DOCUMENTS

| | | | | |
|---|---|---|---|---|
| 3,989,239 | A * | 11/1976 | Scriven et al. | 271/204 |
| 4,408,755 | A | 10/1983 | Meier | |
| 4,614,290 | A | 9/1986 | Boss | |
| 4,729,554 | A | 3/1988 | Honegger | |
| 5,137,409 | A | 8/1992 | Honegger | |
| 5,324,014 | A | 6/1994 | Honegger et al. | |
| 5,464,199 | A | 11/1995 | Stauber | |
| 5,551,682 | A | 9/1996 | Luthi | |
| 5,564,685 | A * | 10/1996 | Reist | 270/52.18 |
| 5,590,828 | A * | 1/1997 | Stauber | 227/81 |
| 5,713,565 | A * | 2/1998 | Meier | 270/52.16 |
| 5,716,182 | A | 2/1998 | Leu | |
| 5,716,190 | A * | 2/1998 | Rathert | 414/794.3 |
| 5,772,391 | A * | 6/1998 | Sjogren et al. | 414/790.9 |
| 5,863,571 | A | 1/1999 | Santais et al. | |
| 5,950,511 | A | 9/1999 | Luthi | |
| 5,961,758 | A * | 10/1999 | Honegger | 156/73.1 |
| 6,655,674 | B2 * | 12/2003 | Muller | 270/52.18 |
| 6,708,968 | B2 | 3/2004 | Honegger | |
| 6,948,292 | B2 | 9/2005 | Romagnoli | |
| 7,591,223 | B2 | 9/2009 | Möckli | |
| 7,637,489 | B2 | 12/2009 | Brunner et al. | |
| 2003/0019722 | A1 | 1/2003 | Muller | |
| 2004/0089991 | A1 | 5/2004 | Stauber | |
| 2005/0236757 | A1 * | 10/2005 | Mockli | 270/52.14 |

(Continued)

FOREIGN PATENT DOCUMENTS

| | | |
|---|---|---|
| EP | 0390733 | 10/1990 |

(Continued)

*Primary Examiner* — Joseph A Dillon, Jr.
(74) *Attorney, Agent, or Firm* — Pauley Petersen & Erickson

(57) ABSTRACT

A device and method for transport of flexible, two dimensional products and performance of associated production processing of those products, by which the flexible, two-dimensional products are serially conveyed to a workstation and are conveyed away from the workstation again by the same gripper transporter, which enables the workstation to be selectively removed from the production process being performed along the transport path of the printed products, and to be selectively re-introduced again the transport path, in a flexible manner.

11 Claims, 6 Drawing Sheets

U.S. PATENT DOCUMENTS

| | | | | |
|---|---|---|---|---|
| 2006/0179988 | A1* | 8/2006 | Mockli et al. | 83/213 |
| 2008/0149464 | A1 | 6/2008 | Möckli | |

FOREIGN PATENT DOCUMENTS

| | | |
|---|---|---|
| EP | 0390734 | 9/1994 |
| EP | 0606555 | 3/1997 |
| EP | 0628429 | 4/1997 |
| EP | 0662440 | 7/1997 |
| EP | 0691215 | 8/1997 |
| EP | 0762950 | 12/1998 |
| EP | 1254857 | 11/2002 |
| EP | 03025534 | 11/2003 |
| EP | 1418146 | 5/2004 |
| GB | 05861 | 0/1911 |
| RU | 2168453 | 6/2001 |
| UA | 60258 | 9/2003 |
| WO | WO 02/36474 | 5/2002 |

* cited by examiner

PROCESSING ON A TRANSPORTER

CLAIM OF PRIORITY

This application is a continuation of co-pending patent application Ser. No. 12/043,618, filing date 06 Mar. 2008, which is a continuation of patent application Ser. No. 11/111,948, filing date 22 Apr. 2005. The co-pending parent application is hereby incorporated by reference herein in its entirety and is made a part hereof, including but not limited to those portions which specifically appear hereinafter.

This application makes reference to, incorporates the same herein, and claims all benefits accruing under 35 U.S.C. §119 from the filing of an application entitled PROCESSING ON A TRANSPORTER filed with the Swiss Federal Institute of Intellectual Property on 22 Apr. 2004, and there duly assigned Ser. No. 707/04.

BACKGROUND OF THE INVENTION

1. Field of the Invention

The invention relates to conveyors and, more particularly, to methods and devices for transferring and for processing of flexible, two-dimensional products, such as printed products.

2. Discussion of Related Art

In the conveyor technology and, in particular, conveyor technology for the conveyance of flexible, two-dimensional objects such as printed products, it is known in the art to convey such flexible, two-dimensional objects, or printed products, with the help of grippers that grasp the objects and serve as transporters. In particular, the products are conveyed from one workstation to the next workstation with the help of such gripper transporters. Each gripper transporter is, as a rule, driven at the same time and is controlled separately. This demands a corresponding number of drive units and controllers, which concomitantly requires a correspondingly high expense invested in capital equipment and in the maintenance of that equipment.

Transport between the workstations is effected along working paths with such gripper transporters, which are not at all flexible in use. If one working step is to be omitted from the manufacturing process, then a new transport path needs to be constructed to pass the associated workstation; moreover, when a workstation is removed from the working path, a transport path with a gripper transporter needs to span the space of the workstation that was removed. Consequently, I have discovered that any change in the work flow process may be both time and cost intensive.

Examples of such inflexible working paths are disclosed in a patent entitled *Process And Device For Handling Printed Products* by Ernst Luthi, issued as EP 0762950 B1, and in a patent entitled *Improvements In Printing Machines* by Herbert Fumival, et al., issued as GB 5861 on the 9 Feb. 1910. In GB 5861, the printed product to be cut is carried by the grippers of a gripper transporter to a cutting station, is transferred to the cutting station, and after the cutting, is transported away from the cutting station by way of either the grippers of the same transporter or by the grippers of a second gripper transporter connected downstream. In EP 0762950, the printed products that are conveyed during the cutting process are transferred to tension clips in order to stabilize these products during the cutting process, and are held in a fixed position. The grippers of the gripper transporter remain allocated during the cutting process to the printed products held by the tensioning clips so that the printed products are supplied to the cutting station and are led away from the cutting station again in each case by the same grippers.

In both devices, the cutting stations are a fixed component of the transport device. Such devices however, provide only desultory satisfaction of contemporary demands for a rapid resetting of the production line, e.g. a switch in production from large daily newspapers to weekly magazines, brochures and to different newspapers and magazines of varying size.

SUMMARY OF THE INVENTION

It is therefore, an object of the present invention to provide an improved device and method for transporting two-dimensional, flexible products between workstations.

It is another object to provide a device and method amenable to quick and inexpensive reconfiguration, for transporting flat objects of varying dimensions between a sequence of workstations.

It is still another object to provide a device and method for transporting two-dimensional, flexible products between workstations in an inexpensive and flexible manner.

It is yet another object to provide a device and a method with which the transport and any associated processing of two-dimensional, flexible products may be achieved in an inexpensive and flexible manner.

It is a further object to provide a device and a method with which the transport and any associated processing of two-dimensional, flexible products may be achieved between a varying plurality of workstations in an inexpensive and flexible manner.

It is an additional object to provide a device and a method amenable to rapid accommodation of alterations in the manufacturing processing of two-dimensional, flexible products.

According to the principles of the invention, the method and the device contemplate transport of each of a stream of flexible, two-dimensional manufacturing products, and in particular, printed products, with the same gripper transporter conveying an object to a workstation as well as away from that workstation. With the guidance of a controller, a logical allocation may be made between the flexible, two-dimensional products and grippers of the gripper transport in each case. Additional workstations may be introduced into the transport path and other workstations may be removed from the transport path, according to specific requirements for the current production run. In this manner, both the investment in capital equipment and the cost of maintenance for the capital equipment may be reduced to that for a single gripper transporter while concomitantly rendering the production line more flexible and readily adaptable to the specifications for different products. Flexible, two-dimensional products may be grasped and held by the grippers of the transporter at either the open end or at the fold.

Control may be realized in a particularly simple manner with a logical allocation of the same gripper that has conveyed a flexible, two-dimensional product to a workstation also transporting the same flexible, two-dimensional product away from that workstation.

At the same time, control is simplified because the gripper of the flexible two-dimensional product may be synchronously led together with the flexible, two-dimensional product during the manufacturing process, wherein the control of the gripper, and in particular, a slotted control guide for the gripper in the region of the processing, may be set in a variable manner so that the grippers for the conveyance of flexible, two-dimensional products may be either opened or may alternatively remain closed. Closed grippers are, above all, very useful for printed products, such as products assembled with several sheets folded together as a tabloid or products assembled with the insertion of enclosures between several sheets that have been folded together or that are to be connected to one another, such as by way of either stapling, stitching, gluing or other bonding of the constituent parts The controller however, regulates the device and the processes performed so that there is a logical allocation of grippers and flexible, two-dimensional products to one another, with a gripper which has conveyed a flexible, two-dimensional product to a workstation, conveying another flexible, two-dimensional product away from the workstation. In this manner the controller may master speed differences.

Where necessary during the manufacturing process, flexible, two-dimensional products are supported during their manufacture by a support element. Depending upon whether the flexible, two-dimensional products are grasped and held by the grippers of the transporter at their open ends or at their folds, the products are either deposited onto the support elements with their folds upright and at the top or, alternatively, the support elements may be introduced between the products and support the flexible, two-dimensional products at their folds, which are directed downwardly.

The transport may lead over several workstations which may be arranged downstream in a serial manner along the transport path of the gripper transporter, or alternatively, arranged in parallel guided lines of the gripper transporter that are connected to one another via diverters, or points.

Workstations may be removed from the transport path of the gripper transporter by way of pivoting, or by hydraulically, electrically or pneumatically induced movement, such as by lowering or lifting the workstation, and the work paths may be rearranged in a very flexible manner; consequently the practice of the invention accommodates changes in the number and types of workstations, as well an rearrangement of the path of conveyance without much technical effort, thereby readily permitting the omission or incorporation of work steps into the path of conveyance through the manufacturing process.

If a device constructed according to the principles of the present invention is designed to lead a transporter along its transport path past a workstation, then the workstation preferably comprises a covering. When a corresponding step and the associated workstation are omitted from the manufacturing process, problems which would formerly be attributable to the conveyance of the flexible, two-dimensional products past the unused workstation may be conveniently avoided in the practice of the present invention Connecting devices, and in particular, stapling or stitching apparatus, or combined stapling and stitching apparatus, ultrasonic devices, mechanisms to apply glue or other adhesives for bindings, devices to place inserts into flexible, two-dimensional products, end-of-path collection, collection stapling, or stitching, paths, end-of-path insertion, and insertion, stapling, or stitching paths may be selectively provided as workstations, in conformance with the specifications of each manufacturing process.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
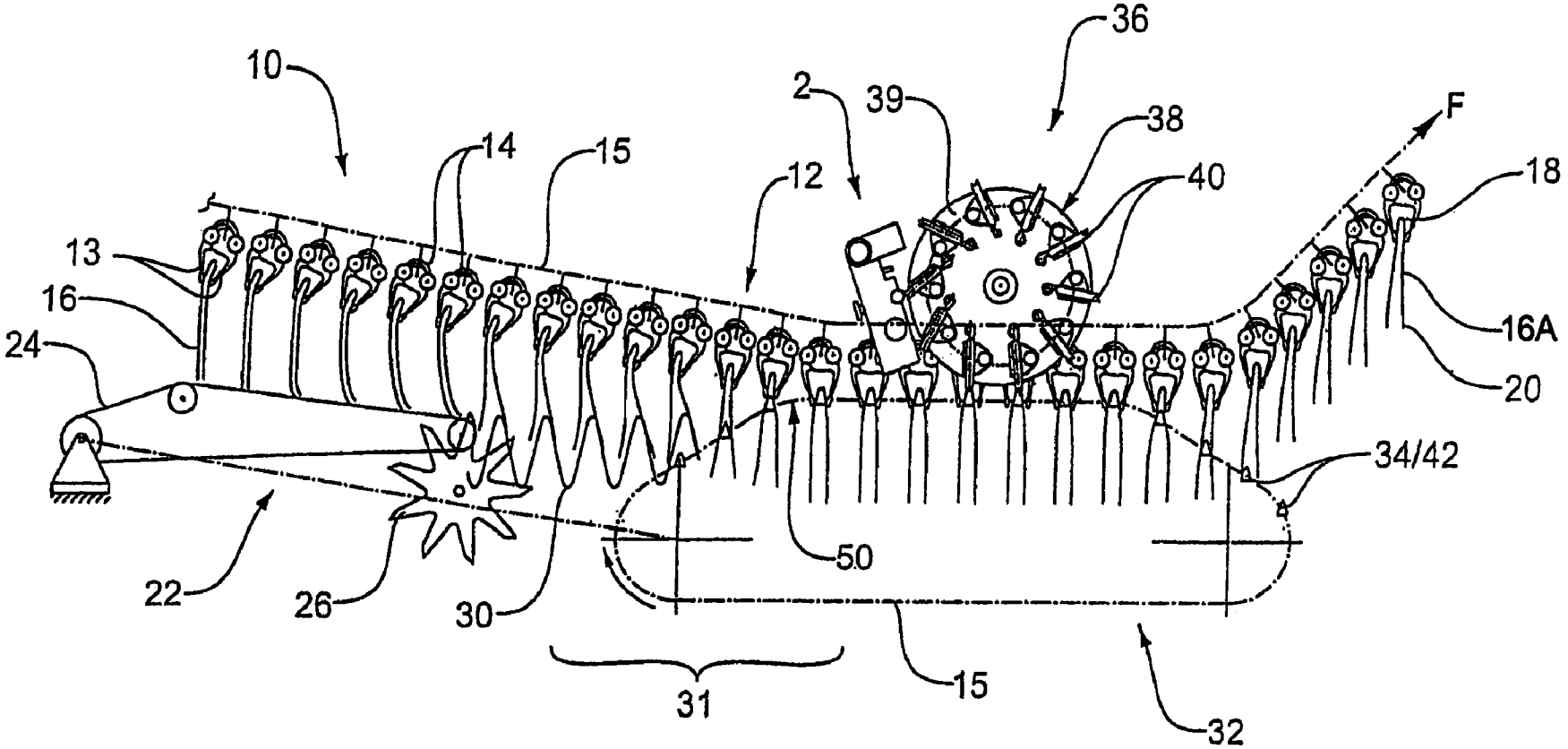
FIG. 1 illustrates a first embodiment of the device constructed according to the principles of the invention, for processing printed products on a transporter.

Turning now to the drawings, it may be noted that the examples represented in FIGS. 1 to 10 relate to the transport of substantially flat, flexible manufactured products 16 such as one or more sheets of printed material which are typically folded into tabloid form, and which individually, or with several similar sheets laid over one another, are transported by way of a gripper transporter, or conveyor, 12 independently of the number of their individual sheets, or layers. For the sake of simplicity, a single layer is shown in the drawings as representing a printed product 16, although such products typically include multiple layers, or sheets. It is to be understood that other flexible, two-dimensional products 16 may also be transported and processed in this manner. Furthermore, for the sake of simplicity, in the exemplars of the principles of the present invention represented by FIGS. 1 through 8, in each case a stapling/stitching apparatus 38 is represented. As explained below however, it is possible to provide other apparatus or devices as workstations 2, depending on the particular processing steps and the desired resulting product.

FIG. 1 shows a device 10 constructed according to the principles of the present invention with a gripper transporter 12 which on an endlessly revolving conveyor member 15 transports grippers 14. Grippers 14 are equipped with gripping jaws 13 that are able to grasp and hold in the usual manner printed products 16 consisting of several folded sheets. In the example shown here, printed products 16 are grasped and held at their respective folds 18 and are transported by grippers 14 along the conveyor in the direction F. The open-end 20 generally lies vertically opposite from fold 18, of each printed product 16 is directed downwards following gravity.

Device 10 is constructed as one example of the principles of the invention, with an opening device 22, a revolving deflection belt 24, and an opening wheel 26 connected thereto, and a spiral 30 connected to opening wheel 26. Further elements of device 10 include a connecting device 36, which in this example is designed as a rotation stapling/ stitching apparatus 38, as well as a revolver 32 which, with its endlessly revolving conveyor member 15', includes support elements 34 spaced-apart at a defined distance relative to one another.

With stapling/stitching apparatus 38, which is a rotary stapler/stitcher that carries several stapling/stitching heads 40 that are arranged spaced at uniform distances apart around the circumference of carrier disk 39. Other details about this type of stapling/stitching apparatus 38 are described, by way of example, in FIG. 8 of WO 02/36474, and also in EP 0606555 and in EP 0691215. Support elements 34 of revolver 32 may be benders 42 that cooperate with stapling heads 40 of stapling apparatus 38 to carry out a stapling procedure. One may also provide benders 42 that are arranged separately from support elements 34 and that may be moved by support elements 34 in an independent manner.

According to the practice of the invention, printed products 16 are taken from transporter 12 of device 10 and are led directly to a workstation by the rotation and from a buffer or other conveyor. With this, printed products 16 may have one or more individual sheets, or layers, and in any case printed sheets folded in tabloid form or applied over one another (not illustrated here).

Transporter 12 in this example transports printed products 16 into the region of opening device 22, wherein the open ends of printed products 16 run out onto revolving deflection belt 24 of opening device 22 and, by way of belt 24 they are deflected; that is, belt 24 turns printed products 16 to have an orientation toward conveyor direction F, as is shown by FIG. 1. The leaves of printed products 16 are subsequently spread by opening wheel 26 which separates the leaves at the open end, and printed products 16 are transported farther along the conveyor path in direction F while the open ends of the leaves are held open via spiral 30.

In an allocation region 31, opened printed products 16 are gradually laid onto support elements 34 of revolver 32 as transporter 12 and conveyor 15' mutually move support elements 34 toward the apex, or fold, of successive ones of printed products 16. In the example shown here, grippers 14 are not actively opened but remain closed while holding printed products 16, and support elements 34 are drawn by the gradual mutual proximity of transporter 12 and revolver 32 against the clamping effect of gripper jaws 13 to ultimately penetrate between each set of gripper jaws 13. There also exists the possibility of supporting the penetration by way of an adapted opening of the grippers 14, e.g., controlled by slotted guides.

The distance of separation between grippers 14 on transporter 12 as well as the distance between support element 34 carried by revolver 32, and their respective speeds of conveyance, are suitably matched to one another so that an alignment of grippers 14 between printed products 16 and support elements 34 may continuously be attained effortlessly, while grippers 14 run essentially synchronously with support elements 34 in conveyor direction F.

Stapling is effected in the region of the stapling/stitching apparatus 38 in the usual manner a stapling is effected wherein benders 42 integrated into support elements 34 ensure the closure of the wire staples introduced by stapling/stitching heads 40 into printed products 16. It is to be understood that the arrangement of the stapling/stitching heads 40 on carrier disk 39 of rotary stitching/stapling apparatus 38 and well as the rotational speed of carrier disk 39 are respectively matched to the distances separating grippers 34 and support elements 34, together with their corresponding conveyor speeds in the direction of conveyance F.

If benders 42 are not integrated into support elements 34, then benders 42 are led separately to the apex of each printed product 16 to ensure closure of the staples and, if necessary, are guided with these printed products over a suitable section of the movement path of printed products 16 so that a high quality of stapling is achieved.

With the actual stapling procedure, i.e., the insertion of the staples for each of printed products 16 by stapling heads 40, and the subsequent bending of the wire ends to close the staples, it is possible to keep gripper 14 closed without obstructing the insertion and closure of the staples; gripper 14 remains closed but effectively is open to insertion and closure of the staples. The closure of grippers 14 is advantageous if the stapling for example is effected after enclosures have already been introduced into printed products 16. Other details about the process of insertion is described further below.

Figure 2:
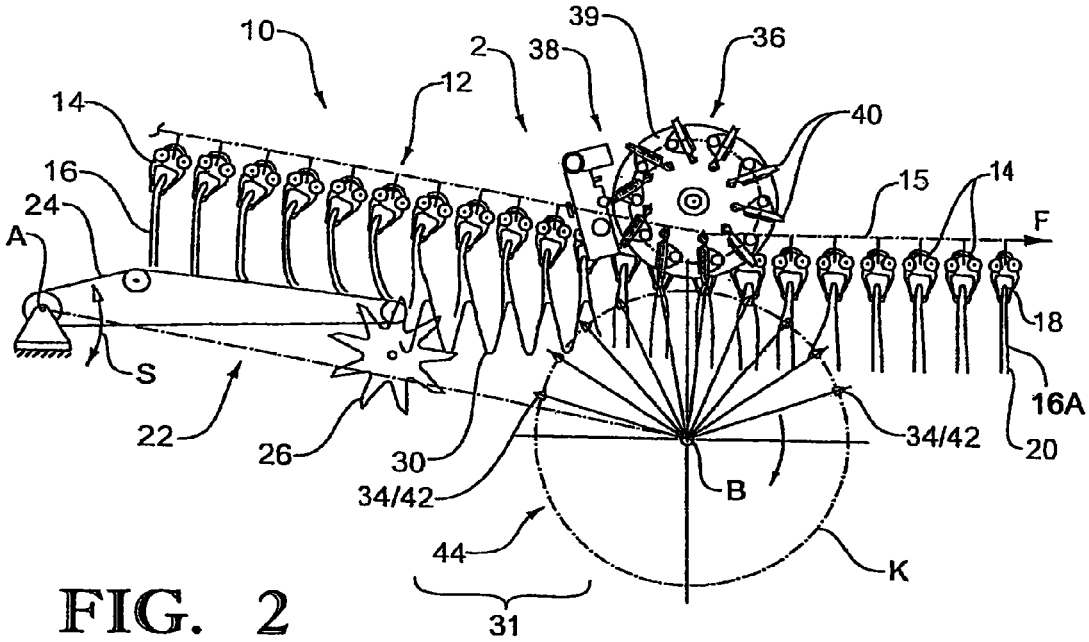
FIG. 2 illustrates a second device constructed according to the principles of the invention for processing printed products on a transporter, while in a first working condition.
Figure 3:
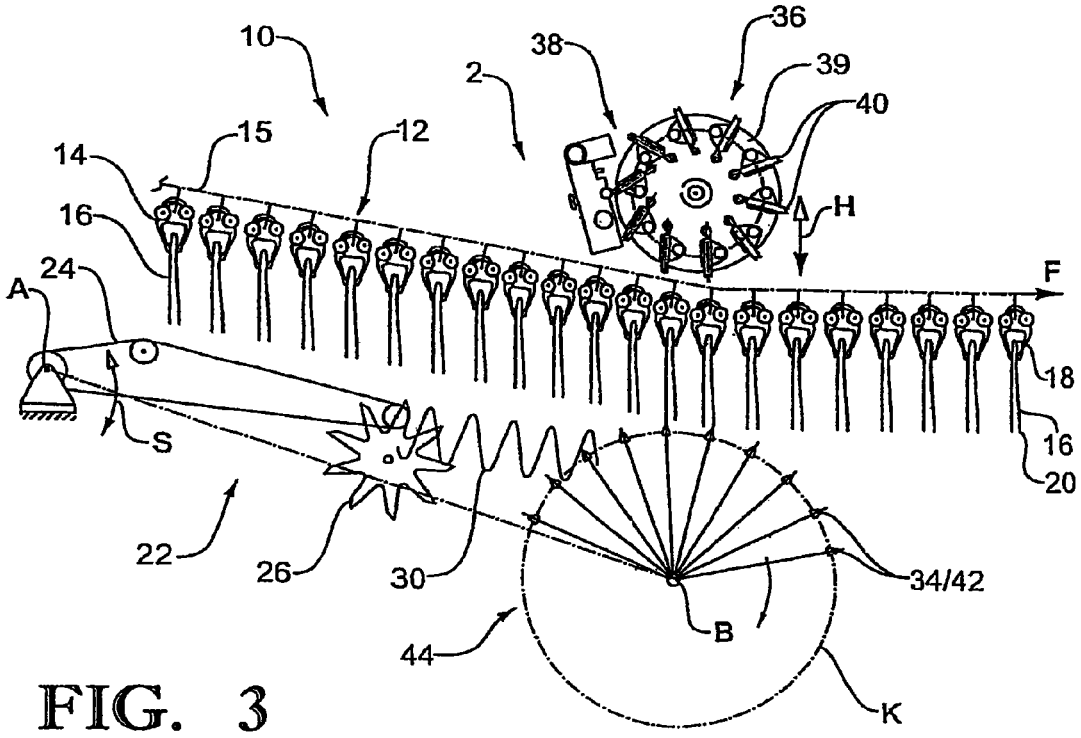
FIG. 3 illustrates the device shown by FIG. 2 while in a second working condition.

A further embodiment of device 10 constructed according to the principles of the invention is shown by FIGS. 2 and 3, in a device that corresponds essentially to the embodiment illustrated by FIG. 1. In contrast to the embodiment illustrated by FIG. 1 however, in the examples shown by FIGS. 2 and 3 support elements 34 are not arranged along a revolver 32 to travel on an endlessly revolving conveyor element 15', but rather support elements 34 are mounted to move on a wheel-like arrangement 44 about a central axis B of rotation around a circular path K.

Support elements 34 may be designed in the form of known saddles, or rests, but may also be designed as benders (cf. FIGS. 9 and 10) designed in a suitable manner. The same also applies to the support elements 34 of the example of the embodiment illustrated by FIG. 1. The method according to the invention as has already been described above in combination with the embodiment illustrated by FIG. 1, which runs analogously to the example shown in FIG. 2.

If the stapling procedure is not carried out, then it is possible to remove stapling apparatus 34 as well as opening device 22 and wheel-like arrangement 44 out of the transport path of transporter 12, as this is schematically represented in FIG. 3. In the example shown here, stapling apparatus 38 is lifted either pneumatically or hydraulically along the direction of arrow H, while wheel-like arrangement 44 and opening device 22 are pivoted along the arc of arrow S downwardly about axis of rotation A and are thus removed from transport path. Opening device 22 and wheel-like arrangement 44 may be arranged on a common machine frame (not shown) which is pivotally mounted on axis A. It is to be understood that depending on the spatial conditions, a lateral pivoting or a pivoting in any other direction out of the transport path is possible. Instead of using either pneumatic or hydraulic lifting, one may also envisage a lowering of stapling apparatus 38. It is also conceivable that electrically powered motors or solenoids may be used for lifting and lowering of these components. It is also just as conceivable to lift or lower stapling apparatus 38 by way of such electrical, pneumatic or hydraulic mechanisms by pivoting, as well as opening device 22 and wheel-like arrangement 44, instead of pivoting them.

Further embodiments of device 10 constructed according to the principles of the invention, or of the method practiced according to the principles of the invention are represented in schematic illustrations provided by FIGS. 4, 5, 7 and 8, which differ from the embodiments shown in FIGS. 1 through 3 essentially by way of the fact that grippers 14 of transporters 12, are opened upon on allocation to, and alignment with, support elements 34, to allow deposit of printed products 16 onto support elements 34. Grippers 14 then release their hold on printed products 16 and support elements 34 support printed products 16 through the stapling workstations; subsequently, as the apex of each printed product is grasped by one of grippers 14 which lifts the newly grasped printed product as the corresponding support element 34 is withdrawn by revolver 15', to enable stapled, printed products 16A to be freely led away from the stapling workstation via connecting device 36.

After completion of the process step performed by stapling apparatus 38, grippers 14 of the same transporter 12 are again led to merge together with the now stapled, printed products 16A riding on support elements 34. Grippers 14 of the same transporter 12 grasp the now stapled printed products 16A temporarily supported by support elements 34 and lead stapled, printed products 16A farther along conveyor direction F. At the same it is possible, depending upon the respective conditions, for gripper 14 of transporter 12 which has deposited a printed product 16A onto a support element 34, to again grip this printed product 16A after stapling station 38, or however for this gripper 14 to grip another printed product 16B. The logical allocation of grippers 14 of the transporter 12 to printed products 16A coming out of connecting device 36's workstation, and in these examples, support elements 34 of revolver 32 and wheel-like arrangement 44 are regulated by a control unit (not shown) for device 10, in order to maintain alignment, mesh, speed and synchronization between the several constituent stages according to the practice of the invention.

Figure 4:
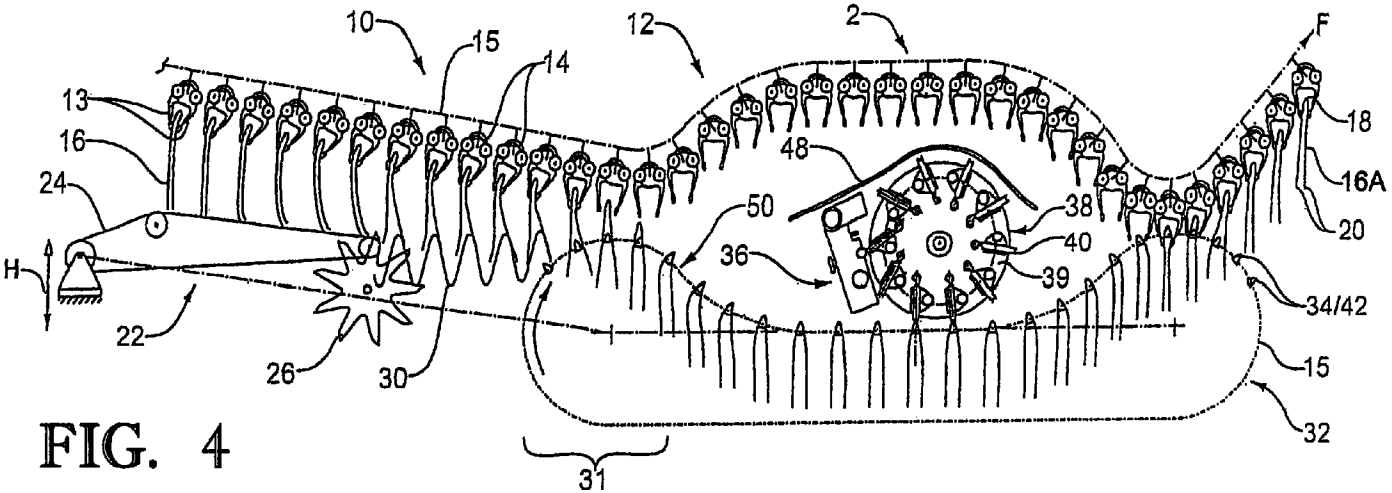
FIG. 4 illustrates a third embodiment of the device constructed according to the principles of the invention.
Figure 5:
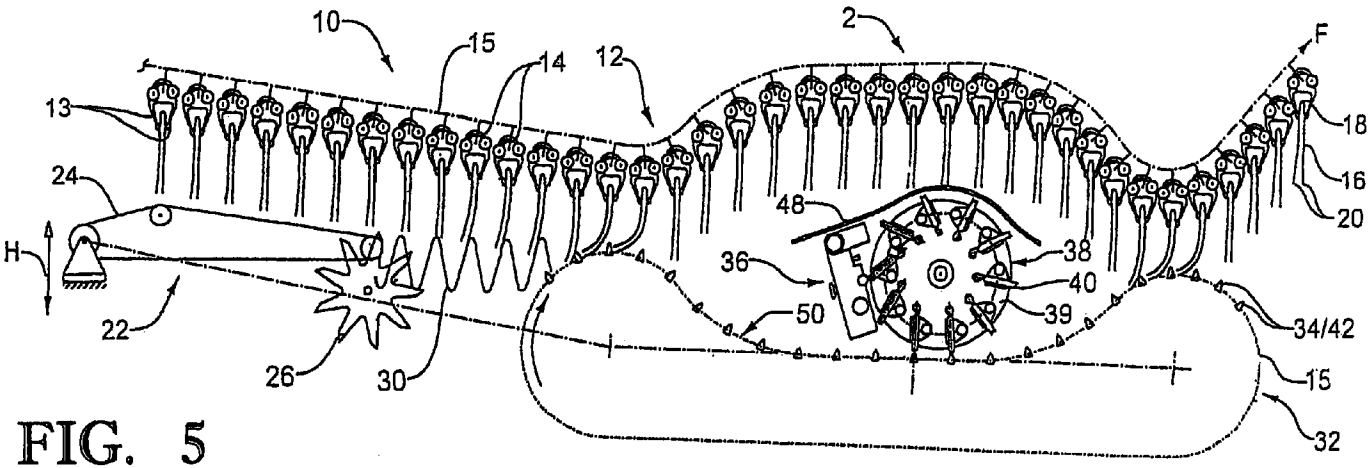
FIG. 5 illustrates the device shown by FIG. 4 while in a second working condition.

The embodiment of device 10 shown in FIGS. 4 and 5 differs from the device 10 shown in FIG. 1 by, among other features, the geometry of the upper face of the revolver 32. Instead of moving towards transporter 12 and then opening into a roughly horizontal course as in FIG. 1, in FIG. 4, upper face 50 within downstream allocation region 31 moves away from transporter 12 in order to then merge into a roughly horizontal conveyor path in the region of connecting device 36. For the return of printed products 16 to transporter 12, upper face 50 again moves downstream away from connecting device 36. In this manner, space is created for connecting device 36 and the transport path of transporter 12 undergoes lesser deflections. In contrast to the embodiment form as represented by FIGS. 2 and 3, in the example shown here in FIGS. 4 and 5 it is possible to move opening device 22, revolver 32 and connecting device 36 out of the transport path of printed products 16 by way of lowering along arrow H, when the workstation "connection to the transporter" is to be deactivated. The situation with the deactivated workstation as shown in FIG. 5. The lowering may again be effected pneumatically, electrically or hydraulically and specifically for the mentioned elements in each case individually or alternatively, via a common machine frame, so that the grippers in this case do not transfer the printed products 16 onto support elements 34. In this case it is necessary for grippers 14 to remain closed. The slotted guide control is to be adapted accordingly. A cover 48 arranged above connecting device 36 prevents complications from occurring during the transport of printed products 16 past connecting means 36.

Figure 6:
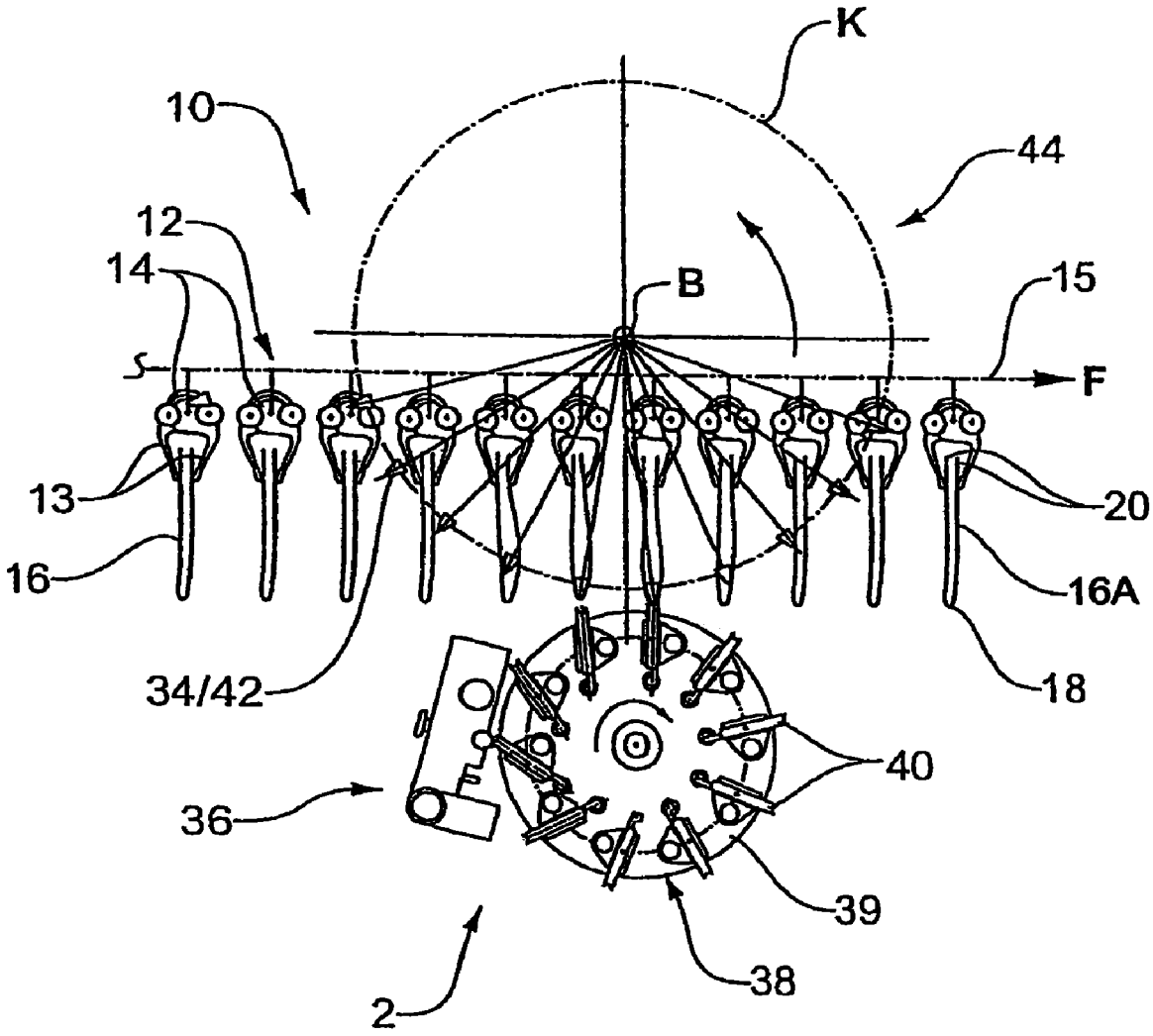
FIG. 6 illustrates a fourth embodiment of a device constructed according to the principles of the invention.

A further embodiment of device 10 constructed according to the principles of the invention is shown in FIG. 6, which corresponds essentially to that of FIGS. 2 and 3. Support elements 34 as in the embodiment of FIGS. 2 and 3 are moved in a wheel-like arrangement 44 about a central rotation axis B around a circular path K. In contrast to the embodiment of FIGS. 2 and 3, in the example shown here, printed products 16 are grasped and held at their respective open ends 20 and are transported by grippers 14 over rotary stapling apparatus 38 along conveyor direction F. Fold 18 of each printed product 16, which lies approximately vertically opposite from open end 20, is directed downwardly in accordance with gravity. Support elements 34 of wheel-like arrangement 44 in this embodiment are designed with a sword, or spear-like shape, and are introduced between the tabloid sides of the flexible, two-dimensional products laterally from above, before the stapling procedure. On stapling or stitching of printed products 16 by stapling apparatus 38, support elements 34 support fold 18, as shown in this example, against upwardly acting force that is imparted during the stapling. With the embodiment shown here, opening device 22 is superfluous. If the stapling procedure is not to be performed, then it is possible to demobilise rotary stapling device 38 and wheel-like arrangement 44, or alternatively, to remove them from the transport path of transporter 12.

Figure 7:
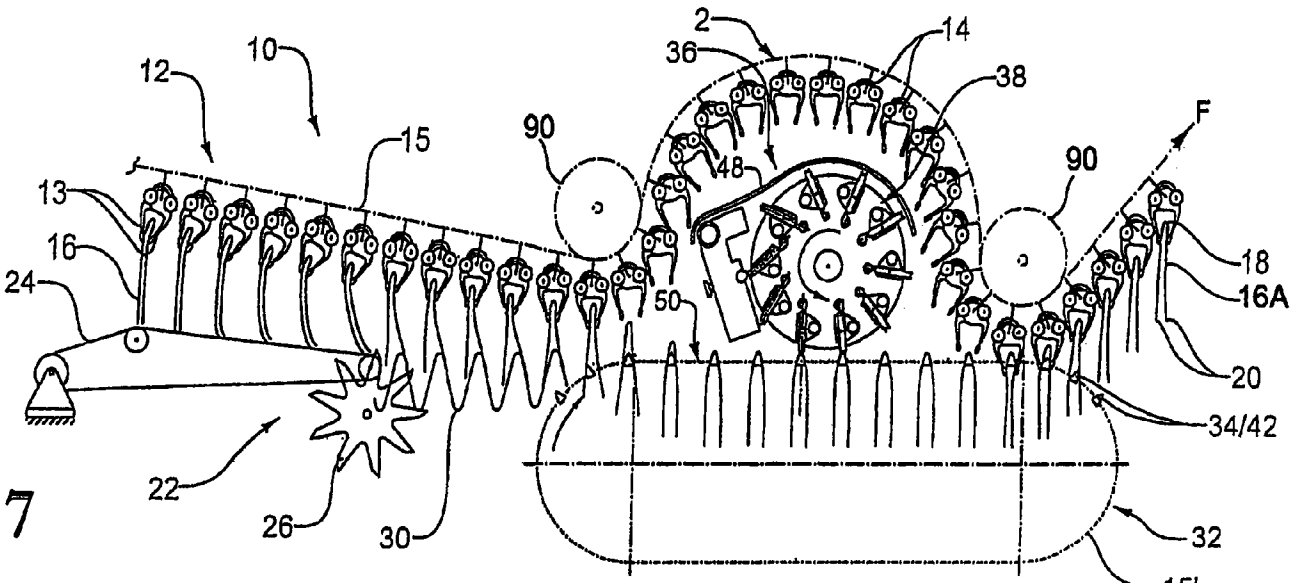
FIG. 7 illustrates another embodiment of a device constructed according to the principles of the invention.

One embodiment is represented in FIG. 7 which corresponds essentially to the embodiment represented by FIGS. 4 and 5, with upper face 50 in this embodiment describing a roughly straight line, while deflection rollers 90 displace the path of conveyor 15 of transporter 12 to arc above, and thereby circumvent rotary stitching and stapling apparatus 38. In order to obtain the space for connecting device 36, the transport path of transporter 12 is designed in this suitably arched manner.

Figure 8:
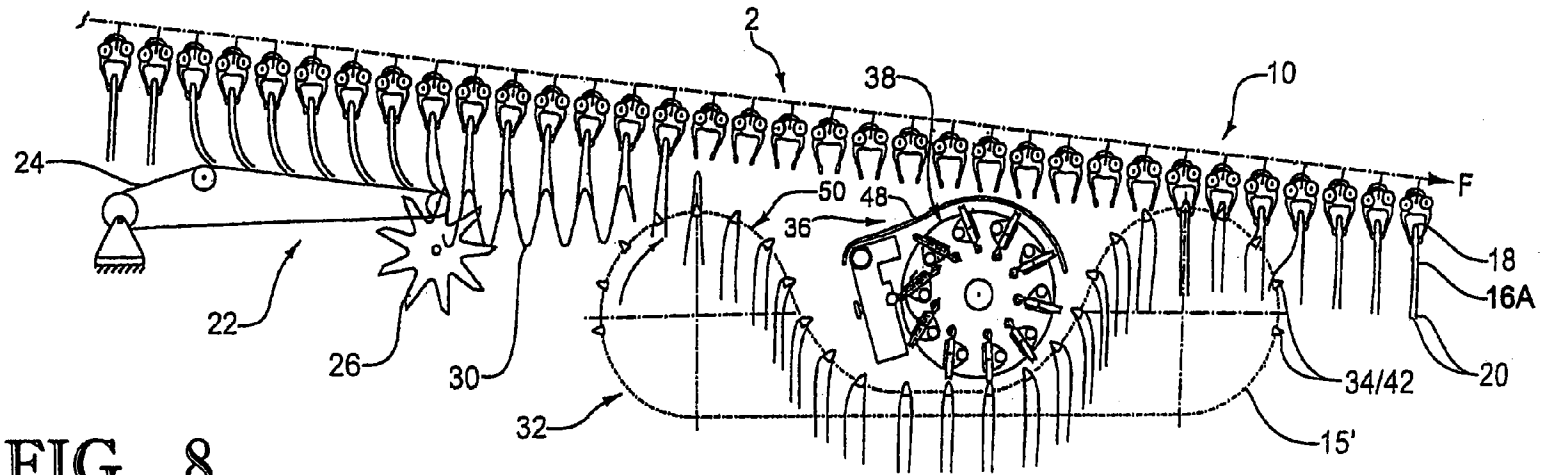
FIG. 8 illustrates a further embodiment of a device constructed according to the principles of the invention.

In the embodiment shown in FIG. 8 the opposite principle is realized. The embodiment corresponds essentially to that of FIGS. 4 and 5, but here the transport path of transporter 12 is led past connecting device 36 in an approximately straight line, and the geometry of upper face 50 of revolver 32 has a suitably large curvature. Advantageously, the radius of curvature of face 50 may be adapted to the radius which stapling heads 40 describe, or alternatively, with a different connecting device 36 such as an ultrasound workstation, may be adapted to the arc which the sonotrodes and other components describe. By way of the flexibility intrinsic in this adaptation, the common path from the support elements and allocated stapling heads, sonotrodes and other constituent components of the different workstations is longer, which has an advantageous effect on the quality of the connection.

It is to be understood that with a somewhat less compact construction as is shown in FIGS. 7 and 8, gradients for gripper transporter 12 or for upper face 50 may be kept lower while accepting a greater path length.

Figure 9:
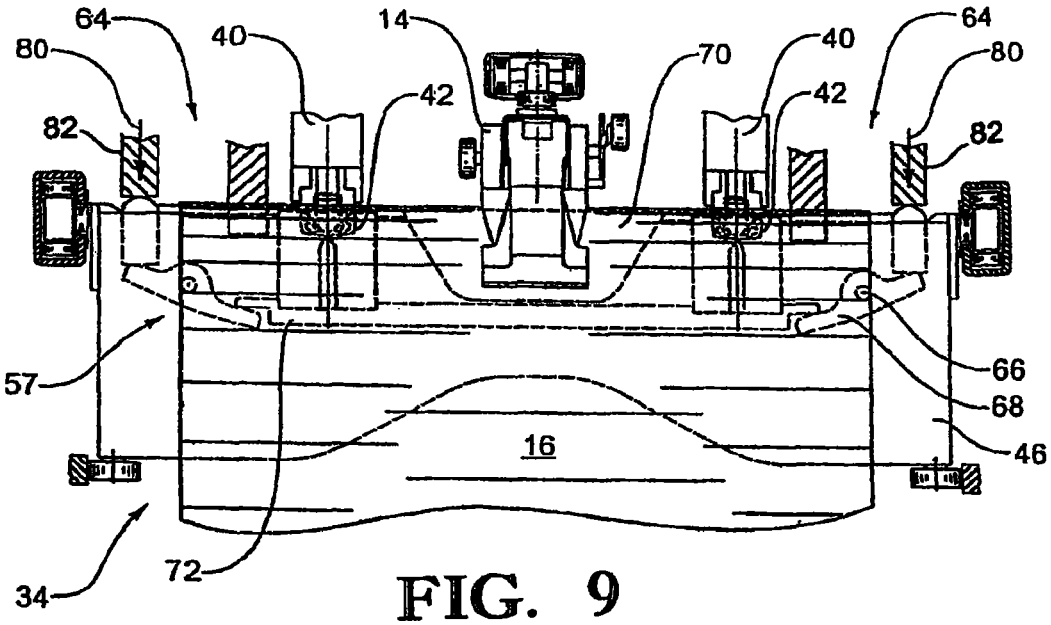
FIG. 9 PRIOR ART
FIG. 9 illustrates details of a support element equipped with benders according to the state of the art, and corresponds to FIG. 7 of European patent application entitled *Vorrichtung zum Sammein and Bearbeiten von gefalteten Druckprodukten* and assigned No. 03025534 filed on 7 Nov. 2003 and publishes as EP 1418146 A2 on the 12 May 2004, with a Swiss priority No. 2002 1886/2 filed on the 9 Nov. 2002, and a corresponding U.S. patent Publication No. 2004/0089991 A1 published on the 13 May 2004 entitled *Device For Collecting And Processing Folded Printed Products*.

Support element 34 with bender 42 according to the state of the art is shown in FIG. 9, and is represented already in principle by way of example, in FIG. 7 of European patent application entitled *Vorrichtung zum Sammein and Bearbeiten von gefalteten Druckprodukten* and assigned No. 03025534 filed on 7 Nov. 2003 and publishes as EP 1418146 A2 on the 12 May 2004, with a Swiss priority No. 2002 1886/2 filed on the 9 Nov. 2002, and a corresponding U.S. patent Publication No. 2004/0089991 A1 published on the 13 May 2004 entitled *Device For Collecting And Processing Folded Printed Products*. Support element 34 is designed in the form of a saddle 46 which includes a recess 70 in its middle so that gripper 14 without any difficulty may grip the printed products deposited on saddle 46 so that printed products 16 never need to be released by grippers 14. Benders 42 may be actuated with the help of bending mechanism 57 integrated into support element 34. Bending mechanism 57 is arranged on the side of support elements 34, to lie opposite printed products 16. The lateral end regions 64 of support elements 34 are constructed with levers 68 mounted to pivot about axes of rotation 66, in each case with two lever arms which lie laterally opposite to one another and which act on carrier element 72 which extends parallel to the longitudinal extension of support element 34. Two benders 42 are spaced-apart from one another, and are supported on carrier element 72 in a manner such that benders 42 may cooperate with stapling heads 40 of an allocated stapling apparatus 38. With the help of stapling heads 42, as is known, wire staples are pushed through printed products 16 lying on support elements 34. Levers 68 may be actuated when controlled by slotted guides 82 to move in the direction of arrows 80, and on actuation, press benders 42 towards stapling heads 40 so that protruding wire ends of staples are bent over by benders 42.

Figure 10:
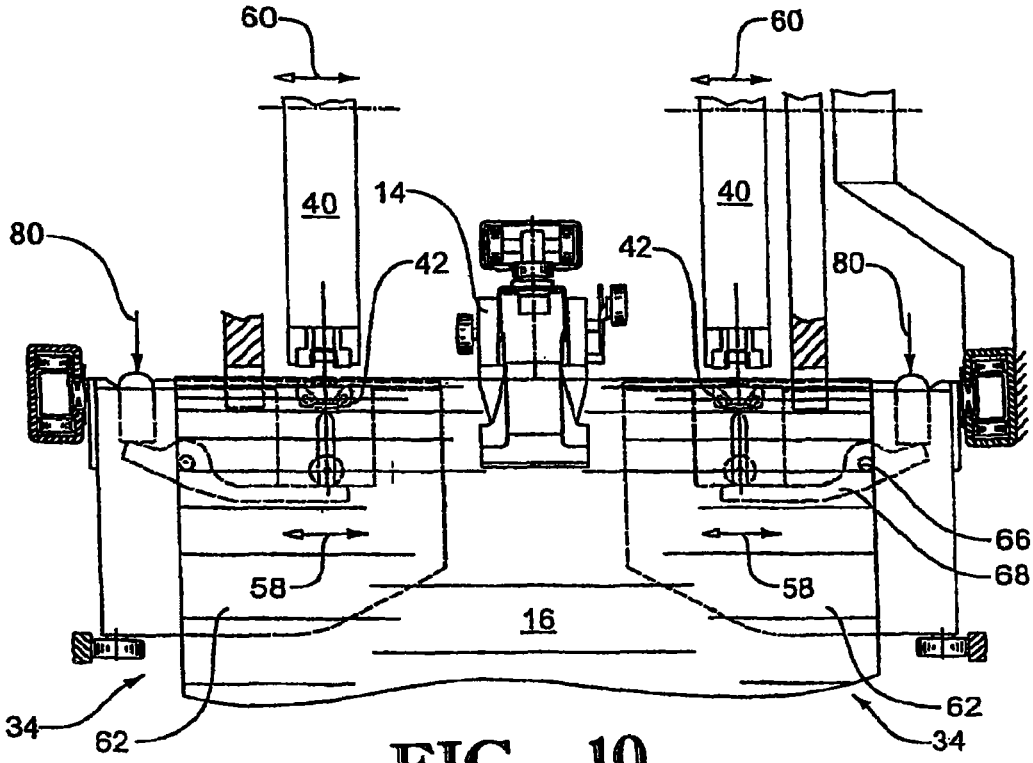
FIG. 10 illustrates a support element constructed with benders according to the principles of the invention.

In order to increase the application possibilities of the device, stapling apparatus 38 and support elements 34 as are shown in FIG. 10 are developed further according to the principles of the invention, to the extent that now the stapling may be adapted to different paper formats. For this, instead of saddle 46, at least two support elements 62 may be provided which in each case stabilize bender 42 and ensure a support of the deposited printed products 16. As in FIG. 9, benders 42 may be actuated under control by slotted guides moving in the direction of arrow 80 with the help of a lever. Instead of via a common carrier element 72, levers 68 may pivot about their axis of rotation 66 to act directly on benders 42. Levers 68 are controlled synchronously, but individually, during operation by way of slotted guides. Benders 42 with their levers 68 are movably arranged on a carrier (indicated by arrows 60) parallel to the longitudinal extension of support element 62. In order to ensure cooperation with stapling heads 40, benders 42 may likewise be moved parallel to the longitudinal extension of support element 34.

In the example shown in FIG. 10, stapling heads 40 and the associated benders 42 are connected to one another such that the respective stapling heads 40 and benders 42 which are allocated to one another may be commonly moved parallel to the longitudinal extension of support element 34.

If the stapling apparatus is constructed with a rotary stapler 38, then stapling heads 40 may be displaced for example, in a direction parallel to the longitudinal extension of support element 34 because carrier disks 39 are displaceable on the axis of rotation stapler 38 in the axial longitudinal direction. A common displacement with bender 42 allocated to stapling heads 40 of a carrier disk 39 is then effected by connection of bender 42 to carrier disk 39 for example via a connecting beam (not shown).

Benders 42 and stapling heads 40 or carrier disks 39 however, may also be moved independently of one another in a direction indicated by arrows 58 parallel to the longitudinal extension of the support element; stapling heads 40 or carrier disks 39 being borne on a first carrier (e.g. the arbor of the rotation stapler) and benders 42 being borne on a second carrier which is indicated in FIG. 10.

It is to be understood that with such a design parallel to the longitudinal extension of support element 34, does not necessarily have to operate with two staplings being made along fold 18 of a printed products 16. One, two or more staplings may be carried out in the longitudinal extension of support element 34, depending of the requirement and the width of printed product 16. Accordingly one, two or more benders 42 with their lever means 68 and stapling heads 40 or carrier disks 39 with stapler heads are to be provided on the carriers.

It is clear that instead of stapling with staples, the present invention may also be practiced with other connecting methods and working steps on the transporter. Thus for example an adhesive connection of printed products 16 may be created. Device 10 according to the invention, then instead of a stapling apparatus 38 be equipped with a suitable device for glue binding, as are for example disclosed in EP 0662440 and EP 0628429. Formation of connections between the several leaves of printed products by way of ultrasound is also conceivable. Suitable is a device for ultrasonic connection as is disclosed such as shown in EP 390733 and EP 0390734, instead of applying stapling apparatus 38 or the device for adhesive binding support elements 34 of revolver 32 or of wheel-like arrangement 44 are then designed accordingly.

A further possible working step which may be carried out on transporter 12 is then the insertion. Thus, for example, stacks which have been formed as in EP 1254857 are inserted into printed products form below in that the transporter is led past a device as is described in FIG. 12 and paragraph 45 of EP 1254857. The method is then carried out as is described in paragraph 45 of EP 1254857, wherein instead of cover sheets, the printed products transported by the grippers 14 of the device according to the invention, are opened, are laid over the stack to be inserted and then together with the stacks are grasped and held again by grippers 14 of the same transporter 12 and transported farther. Printed products 16 at the same time may also have been connected in a preceding working step on the transporter by way of stapling/stitching, gluing or ultrasound. For insertion, device 10 according to the invention in the region in which it is to be inserted, may be simply supplemented by a device as is shown in EP 1254857. It is clear that thus enclosures and pre-products or other matter, may be inserted without difficult.

The device shown in FIG. 12 in EP1254857 may be used in order once again to insert a folded printed sheet or several printed sheets applied over one another at their folds, at the front from below into printed products 16 located in grippers 14 of the device during the practice of the principles of the present invention. The thus inserted printed sheets for their part, may be connected to one another by way of stapling, by stitching, by bonding or by other means. After the insertion of these printed sheets, it is possible with the same transporter to convey the printed products to a farther workstation in which the inserted printed sheets then may, by way of example, be connected to the printed products 16 which are already present in the grippers 14, either by way of ultrasound, bonding or another connection method. Also products created via usual collector paths, such as collector drums, collector stapling/stitching drums, insert drums or other means, may in this manner be brought together with printed products 16 in device 10 according to the principles of the present invention. According to the invention it is also possible to pick up further products from revolvers 34 or collector drums with the transporter according to the invention. It is of course possible to also provide cutting stations as one or more workstations. This however, as also the other workstations, may be removed in a very simple and inexpensive manner from the transport path and when required may be brought back again into the transport path of printed products 16.

From the details set forth in the foregoing description, it is clear in which manner the above described features and examples of the device constructed according to the principles of the present invention and the method may be practices according to those principles may be combined with one another in a meaningful manner. Thus in device 10, according to the principles of the present invention, transporter 12 may be led over workstations which follow one another in a useful manner, wherein the workstations may be the end of an imbricate flow, connecting stations (stapling/stitching, gluing, ultrasound etc,) or the end of a collector or insert path, a device according to FIG. 12, EP 1254857 etc. By way of diverters (points) or by way of the fact that the workstations may be removed from the transport path by way of lowering, lifting, pivoting, and the support elements in the revolvers or in the wheel-like arrangements as well as the stapling/stitching heads etc. may be adapted to the paper format, one may achieve a large flexibility in the use of the whole installation.

What is claimed is:

1. A method for transporting and processing flexible, two-dimensional products comprising:

grasping each of a first plurality of flexible, two-dimensional products in one of a plurality of grippers of a transporter;

conveying the first plurality of flexible, two-dimensional products with the plurality of grippers along a transport path of the transporter;

transporting the first plurality of flexible, two-dimensional products with the plurality of grippers to a working station that is movable between being introduced to the transport path for processing contact with the flexible, two-dimensional products and being removed from the transport path and from processing contact with the flexible, two-dimensional products;

processing the first plurality of flexible, two-dimensional products at the working station introduced to the transport path in a first process consisting of at least one of stapling, stitching, insertion, gluing or ultrasonic joining;

transporting the first plurality of flexible, two-dimensional products with the plurality of grippers away from the working station;

selectively removing the working station from the transport path by at least one of pivoting, lowering or lifting the working station with respect to the transport path;

grasping each of a second plurality of flexible, two-dimensional products in one of the plurality of grippers of the transporter; and transporting the second plurality of flexible, two-dimensional products in the plurality of grippers past the working station removed from processing contact with the second plurality of flexible, two-dimensional products without processing by the working station.

2. The method according to claim 1, wherein the working station is moved by at least one of electrically, pneumatically or hydraulically.

3. The method according to claim 1, further comprising:

processing at least one of the first or second plurality of flexible, two-dimensional products at a second working station in a second process consisting of at least one of stapling, stitching, insertion gluing or ultrasonic joining, wherein the second process is different from a first process of the working station.

4. The method according to claim 3, further comprising:

removing at least one of the working station or the second working station from the transport path.

5. The method according to claim 1, further comprising:

effecting a logical allocation between the flexible, two-dimensional products and dedicated grippers of the transport path with a control means.

6. The method according to claim 1, wherein a common gripper of the plurality of grippers conveys the flexible, two-dimensional products to the working station and away from the working station.

7. The method according to claim 1, further comprising:

selectively opening and closing the gripper during the processing of the flexible, two-dimensional products.

8. The method according to claim 1, wherein a different gripper of the plurality of grippers conveys the flexible two-dimensional product to the working station and away from the working station.

9. The method according to claim 1, further comprising:

supporting the flexible, two-dimensional product with a support element during processing.

10. The method according to claim 1, further comprising:

conveying at least one of the first or second plurality of flexible, two-dimensional products to one or more additional working stations arranged downstream of the working station in a serial manner.

11. The method according to claim 1, further comprising:

applying a cover to the working station:

bypassing the first plurality of flexible, two-dimensional products past the working station with the cover.

* * * * *